United States Patent [19]

Wittler et al.

[11] 4,009,671

[45] Mar. 1, 1977

[54] CONVERTIBLE BED FOR SEWING MACHINES

[75] Inventors: Hilmar Wittler, Karlsruhe; Adolf Martin, Reinstetten-Neu, both of Germany

[73] Assignee: The Singer Company, New York, N.Y.

[22] Filed: Mar. 30, 1976

[21] Appl. No.: 671,807

[52] U.S. Cl. ..... 112/258

[51] Int. Cl.[2] ..... D05B 73/10

[58] Field of Search ..... 112/258, 260, 217.1; 312/23, 21, 29, 208

[56] References Cited

UNITED STATES PATENTS

| | | | |
|---|---|---|---|
| 3,344,762 | 10/1967 | Szostak et al. | 112/260 |
| 3,863,582 | 2/1975 | Patricia et al. | 112/258 |

*Primary Examiner*—George H. Krizmanich
*Attorney, Agent, or Firm*—Edward L. Bell; Robert E. Smith; Julian Falk

[57] ABSTRACT

A convertible sewing machine bed which includes a base having a longitudinally extending cylinder bed and a spring biased work supporting panel that is movable in one direction with respect to the arm and simultaneously shiftable in another direction with respect to the cylinder bed. The shifting movement is effected by the camming action of a single latch detent being moved into and out of a latch seat. The single latch detent and the latch seat, when in engaging relation, also serve to hold the support member in a work supporting position contiguous to the cylinder bed.

3 Claims, 5 Drawing Figures

CONVERTIBLE BED FOR SEWING MACHINES

BACKGROUND OF THE INVENTION

This invention relates work supporting beds for sewing machines, and more particularly, to a sewing machine bed structure which can be converted quickly to accommodate either flat or tubular shaped work pieces.

In a prior convertible bed construction for sewing machines as disclosed in U.S. Pat. No. 3,863,582, a hinged work supporting panel is provided which may selectively be lowered into a retracted position exposing a sewing machine cylinder bed for accommodation of tubular shaped articles or raised to a position providing a substantially coplanar extension of the work supporting surface of the cylinder bed for the accommodation of flat work pieces. In this patented construction, one set of cooperating elements is provided on one edge of the hinged work supporting panel and on the sewing machine bed for selectively retaining the panel in the raised position, while a separate set of cooperating elements is provided on another edge of the hinged work supporting panel and on the sewing machine bed for separating the panel from the sewing machine bed to prevent marring of the finish when the panel is lowered.

SUMMARY OF THE INVENTION

This invention has for an object the provision of a convertible bed construction for a sewing machine employing a hinged work supporting panel in which the problems of providing a latch device for retaining the panel in a selected position and that of providing cooperating cam elements to effect a separation of the parts to prevent damage to the finish is solved by the provision of one set of cooperating elements on the hinged panel and on the sewing machine. This object of the invention is attained by arranging a single latch detent along an edge of the hinged work supporting panel which extends radially from the axis of the hinge and a cooperating latch seat on the sewing machine bed so that the single set of cooperating elements provided by the latch seat and detent will influence not only the angular position of the work supporting panel but also a shift of the panel in the direction of the hinge axis to prevent marring of the finish.

DESCRIPTION OF THE DRAWINGS

The accompanying drawing illustrates a preferred form of this invention in which.

DESCRIPTION OF THE PREFERRED EMBODIMENT

Figure 1:
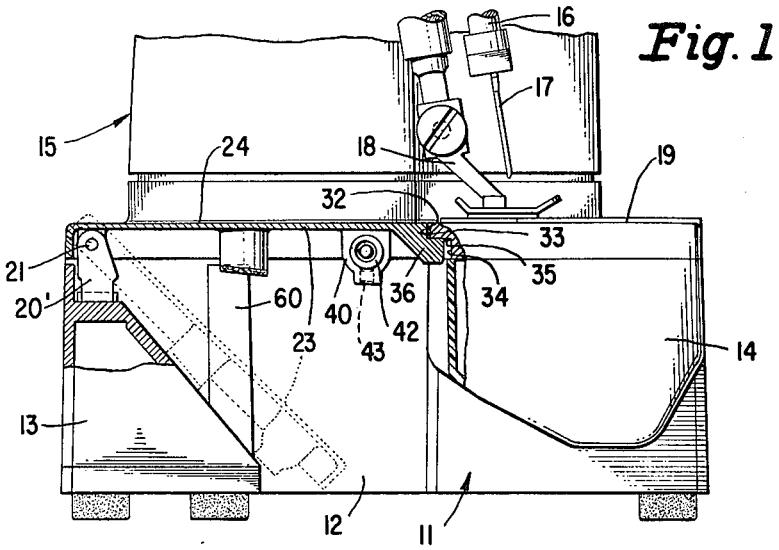
FIG. 1 is an end view of a sewing machine having the convertible bed of this invention applied thereto.

Referring to the accompanying drawing, a bed portion of a sewing machine frame is indicated generally at 11. The sewing machine bed portion preferably comprises a base 12 from which a stabilizing strut 13 projects. The base 12 and stabilizing strut 13 define a plane of support for the sewing machine when it is placed on a table top cabinet or the like. Extending from the base 12 preferably parallel to the stabilizing strut 13 is a cylinder bed 14 extending in cantilever fashion above the plane of support for the sewing machines. The cantilever arrangement of the cylinder bed 14 provides for the accommodation thereon of tubular fabric pieces to be stitched. In FIG. 1 a fragment of a bracket arm portion 15 is shown rising from the bed portion 11. A needle bar 16 carrying a needle 17 is supported with the bracket arm portion and is shown in FIG. 1 in the relationship which it bears to the cylinder bed. Similarly a presser device 18 is carried by the bracket arm 15 in the position shown in FIG. 1 for holding work fabrics on the work supporting surface 19 of the cylinder bed during stitching operations thereon.

The stabilizing strut 13 of the sewing machine bed portion 11 is formed with a boss 20 and carries spaced therefrom a bearing boss 20' to support a hinge pin 21 pivotally engaging hinge bosses 22 formed on a work supporting panel 23. The hinge pin 21 defines an axis of turning movement for the work supporting panel 23 to be swung selectively into a raised position shown in solid lines in FIG. 1 in which a work supporting surface 24 occupies a position contiguous and coplanar with the work supporting surface 18 of the cylinder bed for accommodating flat shaped work pieces, or lowered to a position shown in dotted lines in FIG. 1 in which the work supporting panel 23 occupies a position in spaced relation to the cylinder bed and in which manipulation of tubular shaped fabric articles on the cylinder bed will not be impeded.

Figure 2:
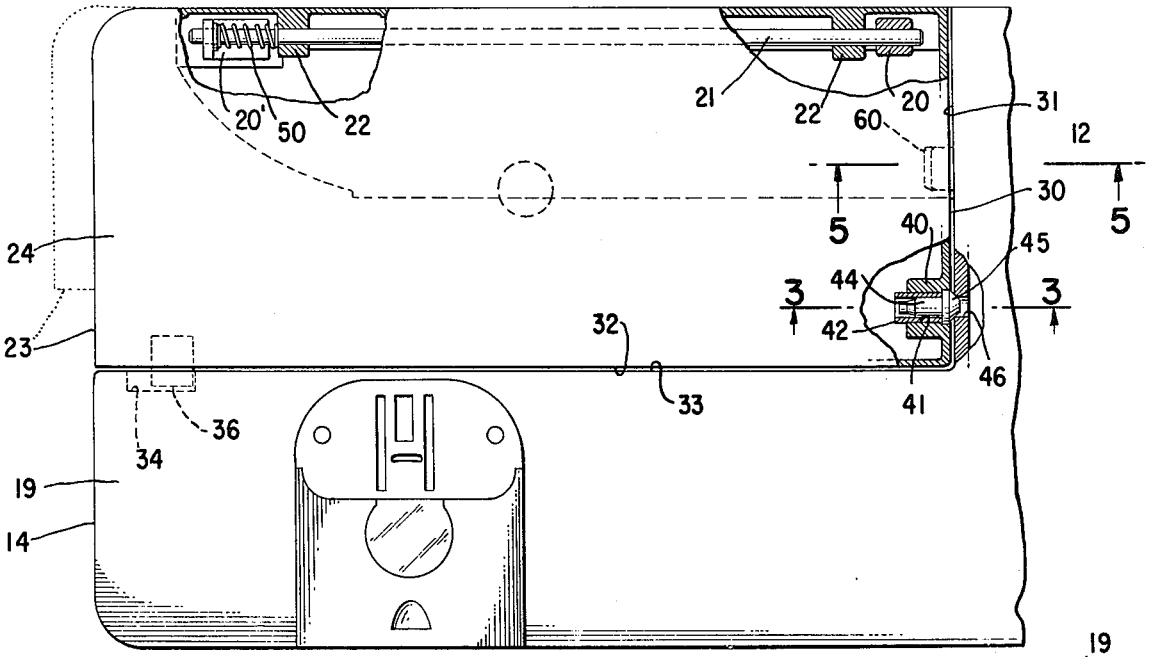
FIG. 2 is a top plan view of the convertible sewing machine bed of FIG. 1 partly in cross section and showing the work supporting panel in work supporting position.

As shown in FIG. 2, the hinged work supporting panel 23 is preferably formed with a shape which is complemental to that of the sewing machine bed portion base 12 and cylinder bed 14 considered in plan view so that when the work supporting panel is raised it will occupy a position contiguous to these sewing machine bed portions thus to provide a continuous substantially flat work supporting surface. To this end, the work supporting panel 23 includes a side 30 which extends perpendicularly from the axis defined by the hinge pin 21, which side 30 is adjacent to the edge 31 of the base 12. The work supporting panel 23 is also formed with a side 32 which extends substantially parallel to the hinge pin 21 and is adjacent to the upper rear edge 33 of the cylinder bed 14.

The cylinder bed 14 is formed adjacent the free extremity of the upper rear edge 33 with a downwardly extending recess 34 of which the upper extremity defines an abutment 35 which is engaged by a stop projection 36 protruding from the edge 32 of the work supporting panel 23 for the purpose of limiting the raised position of the work supporting panel to that in which the work supporting surface 24 is in substantial parallelism with the work supporting surface 19 of the cylinder bed as shown in solid lines in FIG. 1.

The work supporting panel 23 adjacent the edge 30 thereof is formed with a boss 40 formed with an aperture 41 in which a sleeve 42 may be adjustably secured by a set screw 43. Accommodated in the sleeve 42 is the shank portion 44 of a latch detent having an enlarged conical head 45 which protrudes beyond the edge 30 of the work supporting panel 33. The base 12 of the sewing machine bed portion 11 is formed with a latch seat 46 which is positioned so as to accommodate the conical head 45 of the latch detent when the work supporting panel 23 is swung into the raised position.

Figure 3:
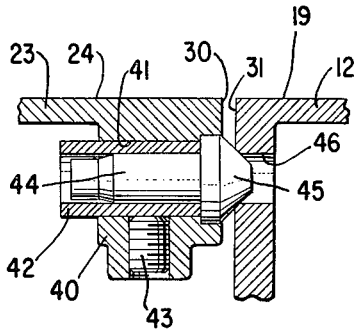
FIG. 3 is an enlarged cross-sectional view of the locking detent taken substantially along line 3—3 of FIG. 2 and showing the work supporting panel in work supporting position.

The work supporting panel 23 is preferably biased in a direction axially of the hinge pin 21 toward the base 12 of the sewing machine bed. Preferably, this bias is provided by a coil spring 50 arranged on the hinge pin 21 between one pair of the respective bosses 20, 20' and 22 which carry the hinge pin. When the work supporting panel 23 is turned into the raised position, therefore, the spring 50 will urge the latch detent into the latch seat and this will releasably lock the work supporting panel into the position shown in solid lines in FIG. 1 in a position effective to support flat shaped work pieces. As shown in FIG. 3, the coil spring 50 will urge the edge 30 of the work supporting panel into closely spaced relationship with the edge 31 of the sewing machine frame base 12 in this position of parts so that a minimum space will be provided therebetween preventing small articles such as pins and the like from dropping therein and an unsightly gap will be obviated.

Figure 4:
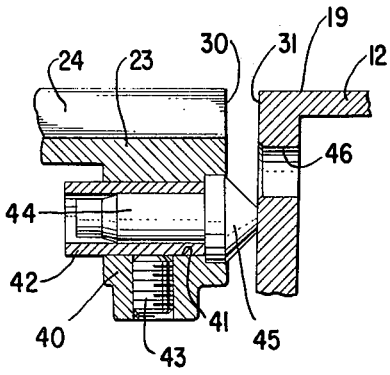
FIG. 4 is an enlarged cross-sectional view of the locking detent taken substantially along line 3—3 of FIG. 2 but showing the work supporting panel moved slightly out of work supporting position.

When the work supporting panel 23 is depressed by the application of a downward force on the work supporting surface 24, movement of the latch detent head 45 out of the latch seat 46 will cam the work supporting panel 23 axially thus to shift the edge 30 of the work supporting panel laterally away from the edge 31 of the sewing machine base 12. The increased space between the edges 30 and 31 as clearly shown in FIG. 4, will insure that marring of the finish of these sewing machine parts will be minimized.

The cooperating latch detent and latch seat described hereinabove can serve without more to releasably lock the work supporting panel 23 in raised position and to shift the work supporting panel axially away from the bed portion base 12 of the sewing machine whenever the panel is depressed so as to minimize marring of the finish.

Figure 5:
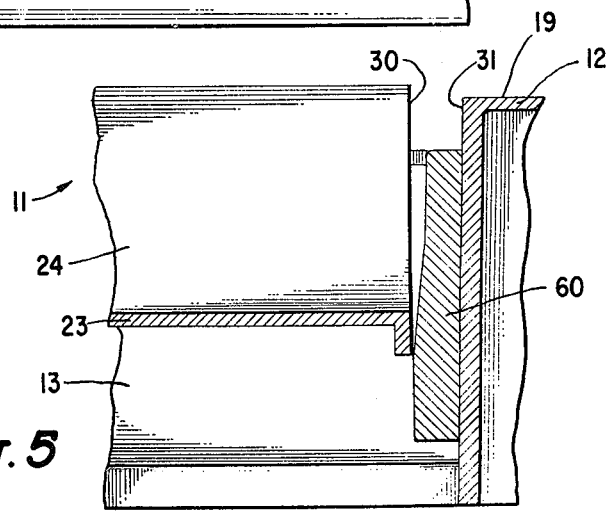
FIG. 5 is an enlarged cross-sectional view taken substantially along line 5—5 of FIG. 2 showing the work supporting panel in the extreme lowered position.

If for any reason, an additional space is desired between the edge 31 of the bed portion base 12, and the edge 30 of the work supporting panel 23 in the depressed position of the work supporting panel, a vertically arranged cam strip 60 may be secured as by adhesives or the like to the edge 31 of the bed portion 12. The cam strip 60 is positioned for engagement with the edge 30 of the work supporting panel after an initial increment of depression of the work supporting panel and the cam strip is preferably wedged shaped as shown in FIG. 5 to influence a gradual further axial shift of the panel away from the edge 31 of the bed portion base 12 as the panel is depressed.

It is well known to provide a cover which may be placed over a sewing machine and which has a handle by which the sewing machine may be carried. These covers have catches which must engage beneath the work supporting panel 23 to prevent the sewing machine from accidentally falling out of the cover while being carried. The cover catches can only engage properly when the work supporting panel occupies the raised position.

The camming strip 60 provides a safety feature by urging the work supporting panel 23 axially in an augmented distance as shown in dotted lines in FIG. 2 so that a cover will be prevented from being accommodated over the sewing machine when the work supporting panel is depressed.

Having set forth the nature of this invention, what is claimed herein is:

1. A sewing machine bed construction readily convertible to accommodate flat or tubular shaped work pieces for a sewing machine having a bed portion including a base, a stabilizing strut projecting from said base and defining therewith a plane of support for said sewing machine, and a cylinder bed formed with a work supporting surface, said cylinder bed extending in cantilever fashion from said base in spaced relation with said stabilizing strut, a retractable work supporting panel formed with a work supporting surface having one side adjacent to said sewing machine bed portion base and one side adjacent to said cylinder bed, means shiftably supporting the work supporting panel on said stabilizing strut for movement in a first direction toward and away from said cylinder bed into and out of a position in which the work supporting surface of said panel and said cylinder bed occupy contiguous and coplanar relation, and in a second direction toward and away from said sewing machine bed portion base, characterized in that a single latch detent is provided projecting from that side of said work supporting panel which is adjacent to said sewing machine bed portion base, and said sewing machine bed portion base is formed with a latch seat located so as both to accommodate said latch detent when the work supporting surface of said panel and said cylinder bed occupy contiguous and coplanar relation thereby holding said work supporting panel in position and to urge said latch detent in said second direction away from said sewing machine bed portion base when said latch detent is forced out of said latch seat thereby shifting said work supporting panel away from sewing machine bed portion base.

2. A sewing machine bed construction as set forth in claim 1 in which the means shiftably supporting the work supporting panel on the stabilizing strut comprises a hinge connection therebetween defining a hinge axis extending substantially parallel to said cylinder bed, characterized in that the latch detent projects from the work supporting panel in a direction substantially parallel to the hinge axis.

3. A sewing machine bed construction as set forth in claim 1 further characterized in that a cam means is arranged to project from said sewing machine bed portion base adjacent to said latch seat to engage said latch detent shifting said work supporting panel an additional distance away from said sewing machine bed portion base over and above that displacement obtained initially when said latch detent is forced out of said latch seat.

* * * * *